US005707091A

United States Patent [19]

Morita

[11] Patent Number: 5,707,091

[45] Date of Patent: Jan. 13, 1998

[54] FASTENER

[75] Inventor: Tamao Morita, Tokyo, Japan

[73] Assignee: Tarmo Company, Limited, Tokyo, Japan

[21] Appl. No.: 659,205

[22] Filed: Jun. 5, 1996

[51] Int. Cl.[6] ..... E05C 17/56

[52] U.S. Cl. ..... 292/251.5; 24/303

[58] Field of Search ..... 292/251.5, 144; 248/206.5, 309.4; 24/303

[56] References Cited

U.S. PATENT DOCUMENTS

| | | | |
|---|---|---|---|
| D. 247,468 | 3/1978 | Morita . | |
| 1,296,427 | 3/1919 | Ramshaw . | |
| 2,901,278 | 8/1959 | Robinson . | |
| 2,975,497 | 3/1961 | Budreck | 24/303 |
| 3,111,736 | 11/1963 | Budreck | 24/303 |
| 3,141,216 | 7/1964 | Brett . | |
| 3,364,532 | 1/1968 | Hatfield . | |
| 4,021,891 | 5/1977 | Morita . | |
| 4,310,188 | 1/1982 | Aoki . | |
| 4,455,719 | 6/1984 | Morita . | |
| 4,480,361 | 11/1984 | Morita . | |
| 4,700,436 | 10/1987 | Morita . | |
| 4,736,494 | 4/1988 | Marchesi . | |
| 4,779,314 | 10/1988 | Aoki | 24/303 |
| 5,142,746 | 9/1992 | Morita . | |
| 5,152,035 | 10/1992 | Morita . | |
| 5,199,138 | 4/1993 | Morita . | |
| 5,208,951 | 5/1993 | Aoki | 24/303 |
| 5,249,338 | 10/1993 | Aoki | 24/303 |
| 5,251,362 | 10/1993 | Riceman et al. | 24/303 |
| 5,253,394 | 10/1993 | Morita . | |
| 5,274,889 | 1/1994 | Morita . | |
| 5,377,392 | 1/1995 | Morita . | |
| 5,432,986 | 7/1995 | Sexton | 24/303 |
| 5,448,806 | 9/1995 | Riceman et al. | 24/303 |
| 5,473,799 | 12/1995 | Aoki | 292/251.5 |

FOREIGN PATENT DOCUMENTS

| | | |
|---|---|---|
| 1351339 | 12/1963 | France . |
| 44-27953 | 11/1969 | Japan . |
| 0973682 | 1/1977 | Japan . |
| 52-77900 | 6/1977 | Japan . |
| 58-108714 | 6/1983 | Japan . |
| 58-145106 | 8/1983 | Japan . |
| 59-18615 | 1/1984 | Japan . |
| 59-119804 | 7/1984 | Japan . |
| 1519246 | 7/1978 | United Kingdom . |

*Primary Examiner*—Rodney M. Lindsey
*Attorney, Agent, or Firm*—Pennie & Edmonds LLP

[57] ABSTRACT

A magnetic fastener has a fastening element N having a strong ferromagnetic component 20 placed on the magnetic pole 10*b* of the permanent magnet 10. The magnet 10 has a hole 11 extend in the direction of magnetic field. The Fastener also has an element to be attracted M having a strong ferromagnetic component 50. The ferromagnetic component 50 will be pulled to the other side 10*a* of the permanent magnet 10 on the fastening element N. The element to be attracted M can also be designed in such a way that the fastening element N snaps on and off through the hole 11. At least one of the ferromagnetic components 20 and 50 protrudes beyond the circumference of the permanent magnet 10 for more than 0.1 mm but no more than 2.0 mm, when the diameter of the permanent magnet is 18 mm.

10 Claims, 21 Drawing Sheets

FASTENER

FIELD OF THE INVENTION

The present invention relates to a fastener which utilizes a permanent magnet and, in particular, enables the fastener to make effective use of the magnetic power of the permanent magnet, which is a part of the fastener.

BACKGROUND OF THE INVENTION

Magnetic fasteners normally comprise a male and a female fastener held together by the magnetic power of a permanent magnet. Examples of such fasteners are shown in FIGS. 16 and 17.

The fasteners represented in FIGS. 16 and 17 comprise a permanent magnet 10, a fastening element N functioning as a female component, and an element M functioning as a male component to be attracted to the fastening element N.

As best seen in FIGS. 1 and 2 the fastening element N is constructed as a unibody with a nonmagnetic case 40. The nonmagnetic case 40 encloses the annular permanent magnet 10, which is a circular plate and has a hole 11 extending substantially perpendicular to magnetic pole surfaces of the magnet 10. A disk-shaped ferromagnetic plate 21 is placed next to one magnetic pole of the permanent magnet 10. A ferromagnetic component 20 is provided to have a ferromagnetic rod part 22 extending into the hole 11 on the permanent magnet 10 and sitting on the ferromagnetic plate 21. The ferromagnetic component 20 further comprises a leg component 30.

The element to be attracted M is constructed as a unibody embracing a ferromagnetic component 50 having a ferromagnetic rod 52 and a disk-shaped ferromagnetic plate 51. The plate 51 can be attracted to the top surface of the fastening element N. The element M also comprises a leg component 60. The ferromagnetic rod 52 on the element M engages the ferromagnetic rod 22 on the fastening element N contained in the hole 11 of the permanent magnet 10.

In the fastener comprising the fastening element N and the element M, the permanent magnet 10 of the fastener is provided with a ferromagnetic plate 21 placed next to one magnetic pole surface and another ferromagnetic plate 51 placed next to the other magnetic pole surface to receive the magnetism. A magnetic path with relatively small resistance can be created for the fastener by bringing the ferromagnetic rods 22 and 52 into contact with each other.

Therefore, the magnetism provided by the permanent magnet 10 of the fastener will be collected at the contact point between the fastening element N and the attracted element M, which provides more effective engagement for the fastener.

However, on the fastening element N of traditional type fasteners, the ferromagnetic plate 21 of the ferromagnetic component 20 are constructed identically in shape and diameter as the permanent magnet 10 to which the ferromagnetic component 20 is attached. The ferromagnetic plate 51 of the ferromagnetic component 50 on the element M must have the same shape and diameter as the magnetic surface of the permanent magnet 10.

As a result, the ferromagnetic components 20 and 50, which are located next to the surfaces of the magnetic poles of the permanent magnet 10 for creating magnetic field, are constructed with the same shape and the same diameter as the permanent magnet 10. In other words, traditional fasteners thus constructed have the size of the side wall of the permanent magnet 10 equal to the size of both side walls of ferromagnetic parts 20 and 50.

Moreover, the attracting power of this type of traditional fasteners, namely the power of the fastening element N in pulling the attracted element M, cannot be considered as an effective use of the magnetism since such fasteners always lose certain amount of its magnetism when both elements N and M get engaged.

In order to overcome the shortcomings existing in conventional fasteners, the fastener of the present invention is constructed to minimize the amount of magnetism which is not directed at the surface of either the fastening element or the element to be attracted. In addition, the fastener of the present invention can effectively use the magnetism emitted by the permanent magnet for retaining the fastener at a closed position.

SUMMARY OF THE INVENTION

The fastener of the present invention comprises a fastening element N having a permanent magnet with two magnetic poles and a hole extending substantially perpendicular to the magnetic poles. A first ferromagnetic component, preferably a ferromagnetic plate, is arranged adjacent to one magnetic pole of the permanent magnet. The fastener further comprises an element to be attached to the fastening element at the magnetic pole of the permanent magnet in the fastening element. The attracted element has a second ferromagnetic component, preferably a ferromagnetic plate. A rod extends from at least one of the first and the second ferromagnetic components into the hole on the permanent magnet and towards the other of the first and the second ferromagnetic components. At least one of the first and second ferromagnetic components has at least part of its outer wall extending outwardly beyond the circumference of the permanent magnet for an extension of no less than 0.1 mm but no more than 2.0 mm.

BRIEF DESCRIPTION OF THE DRAWINGS

These and other features, aspects, and advantages of the present invention will become much more apparent from the following description, appended claims, and accompanying drawings, in which:

DETAILED DESCRIPTION OF THE PREFERRED EMBODIMENTS

Figure 1:
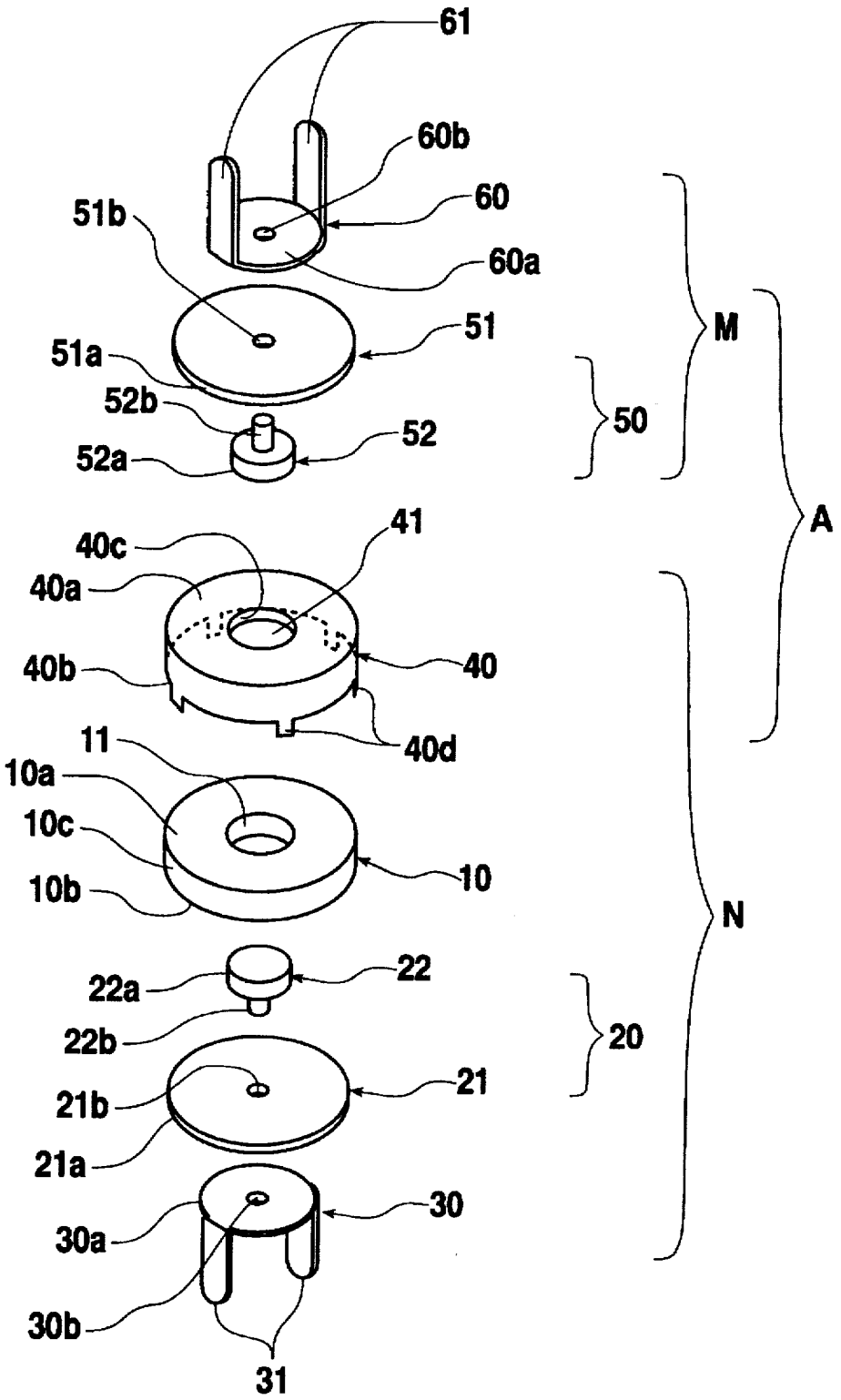
FIG. 1 is an exploded view of the separate parts of the fastener A.
Figure 2:
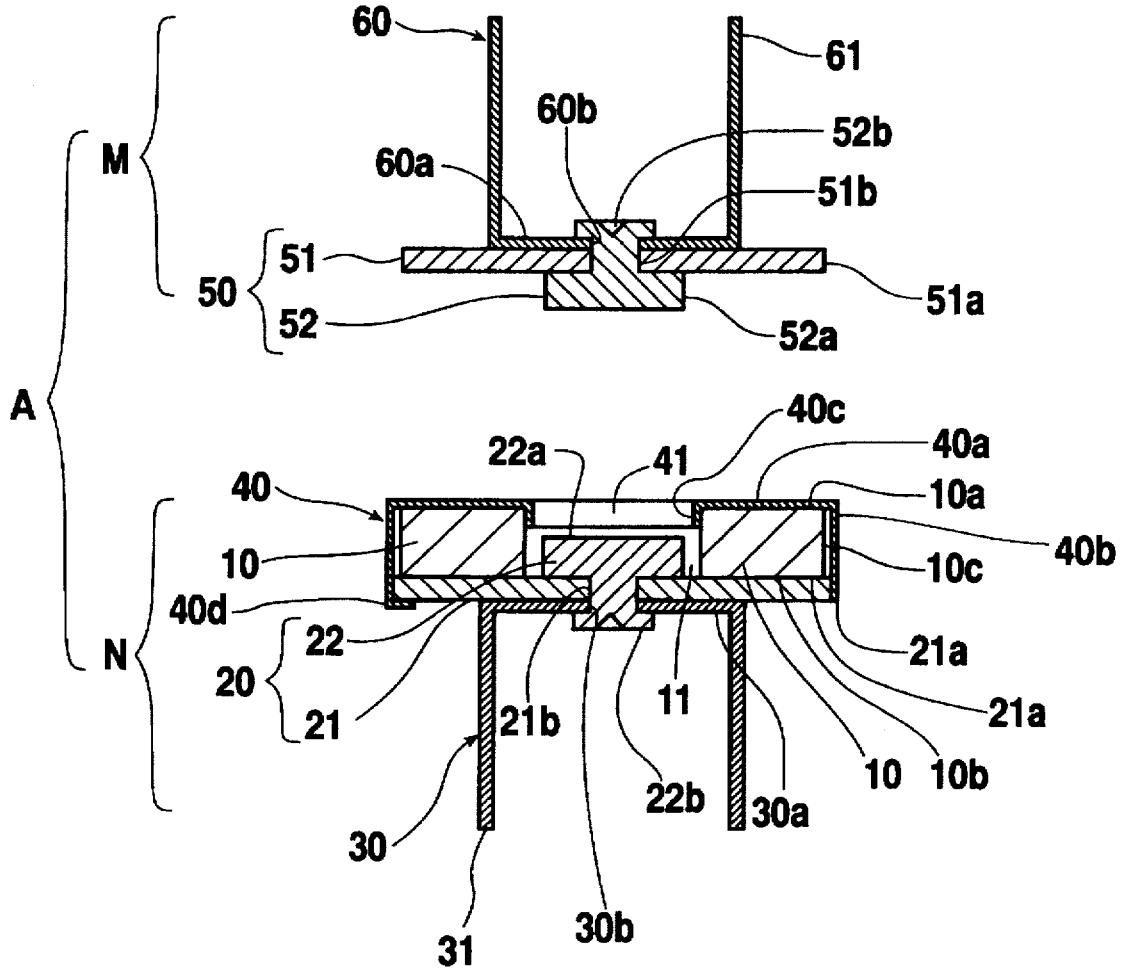
FIG. 2 is a cross section of the fastener A at disengagement.

FIG. 1 illustrates the component parts of general fastener A in the exploded view; FIG. 2 shows the cross-section of the fastening element N and the attracted element M; and FIG. 3 shows the fastener A attached to an object G.

Figure 4:
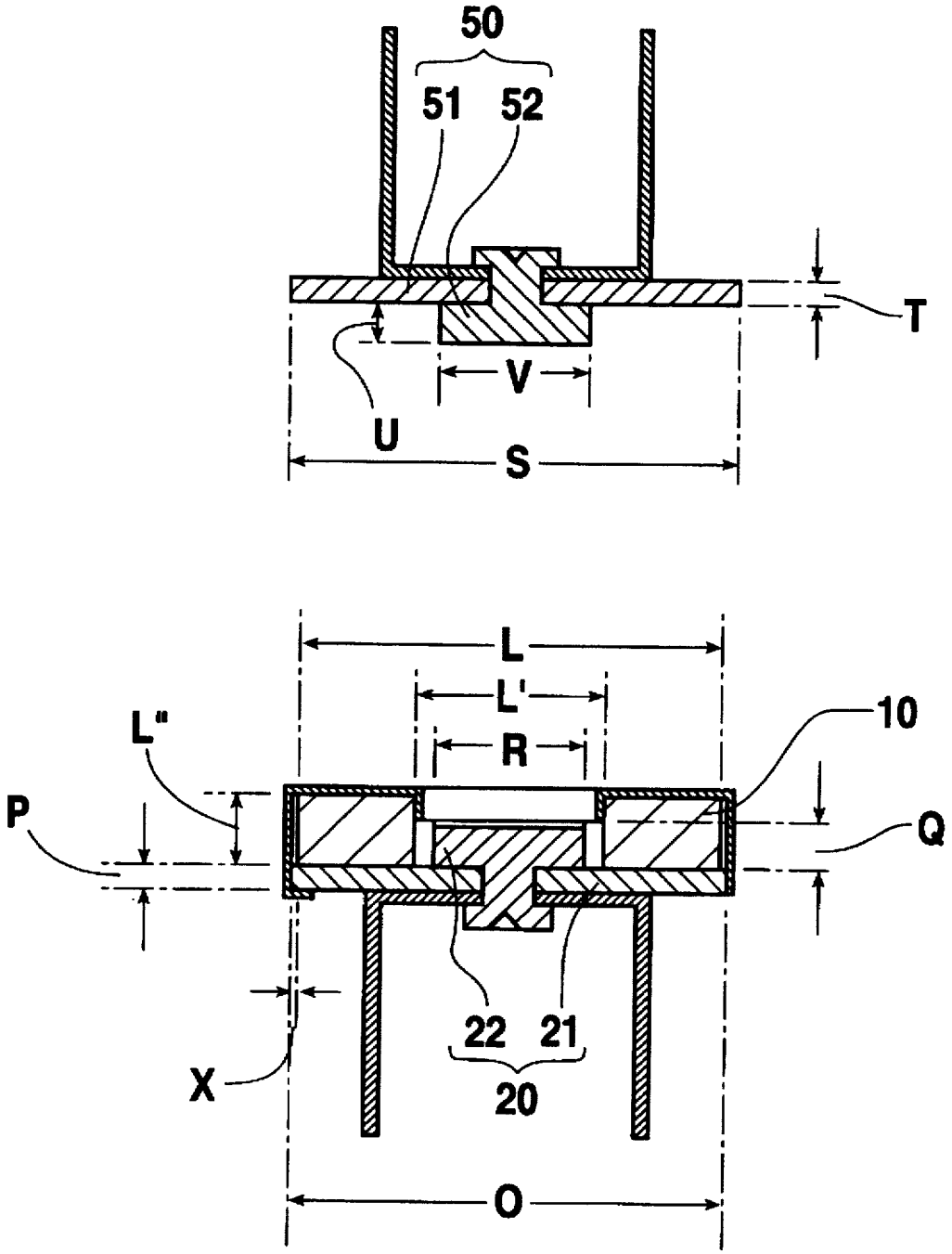
FIG. 4 is a cross section of fastener A-1 at disengagement in the first application case.
Figure 5:
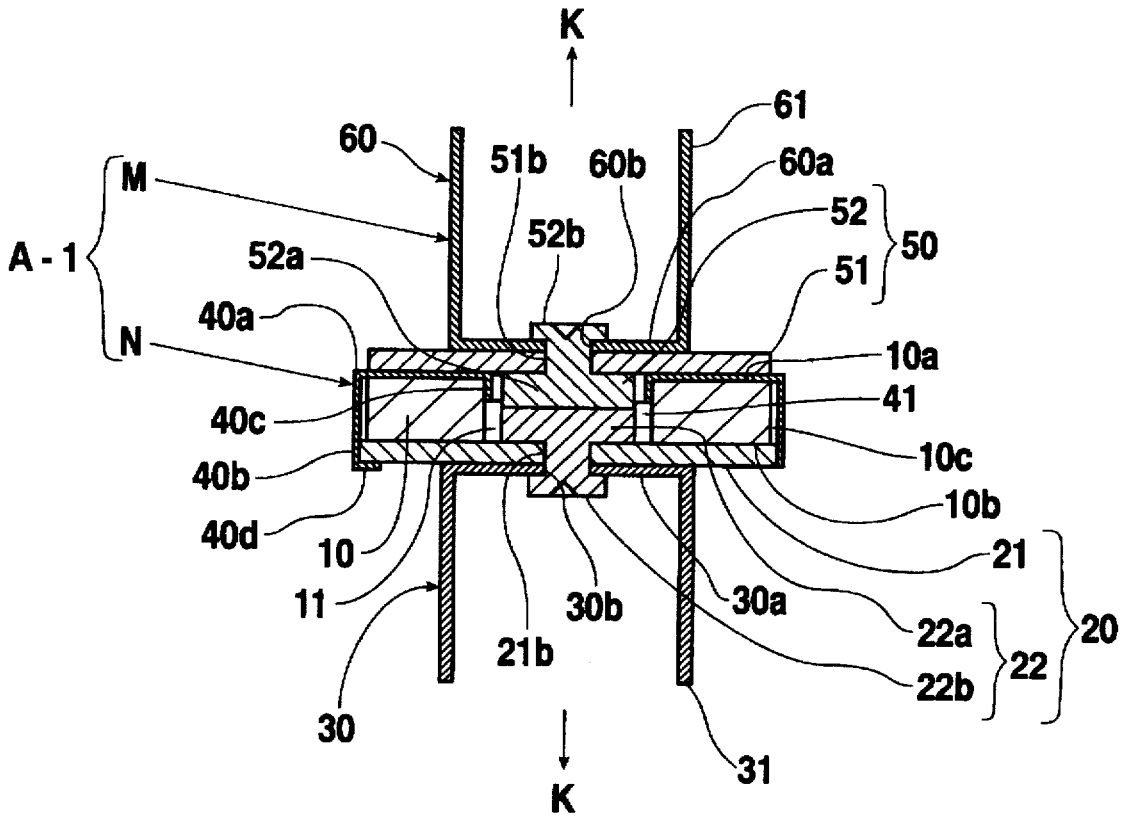
FIG. 5 is a cross section of fastener A-1 at engagement in the first application case.
Figure 6:
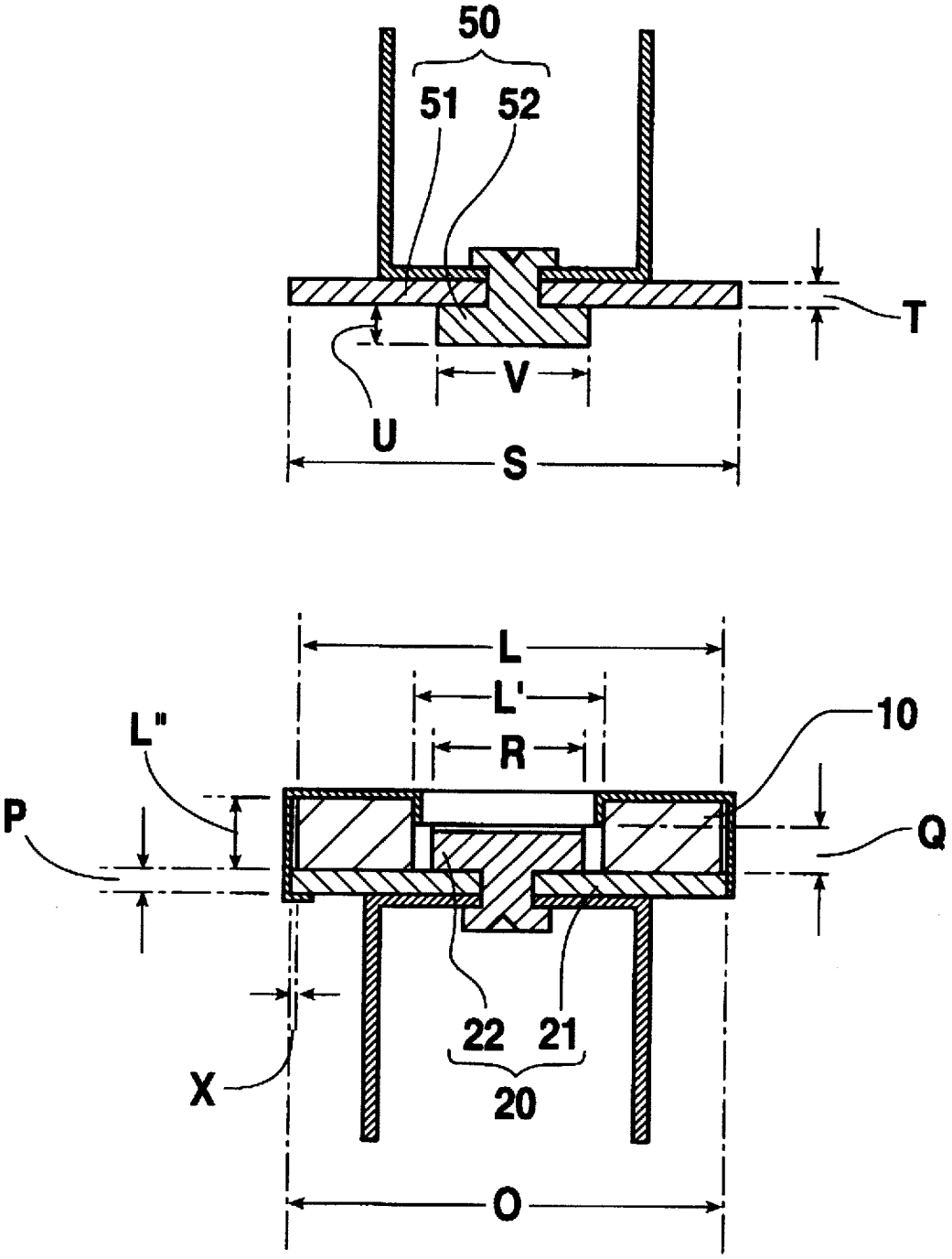
FIG. 6 is a cross section of fastener A-2 at disengagement in the second application case.
Figure 7:
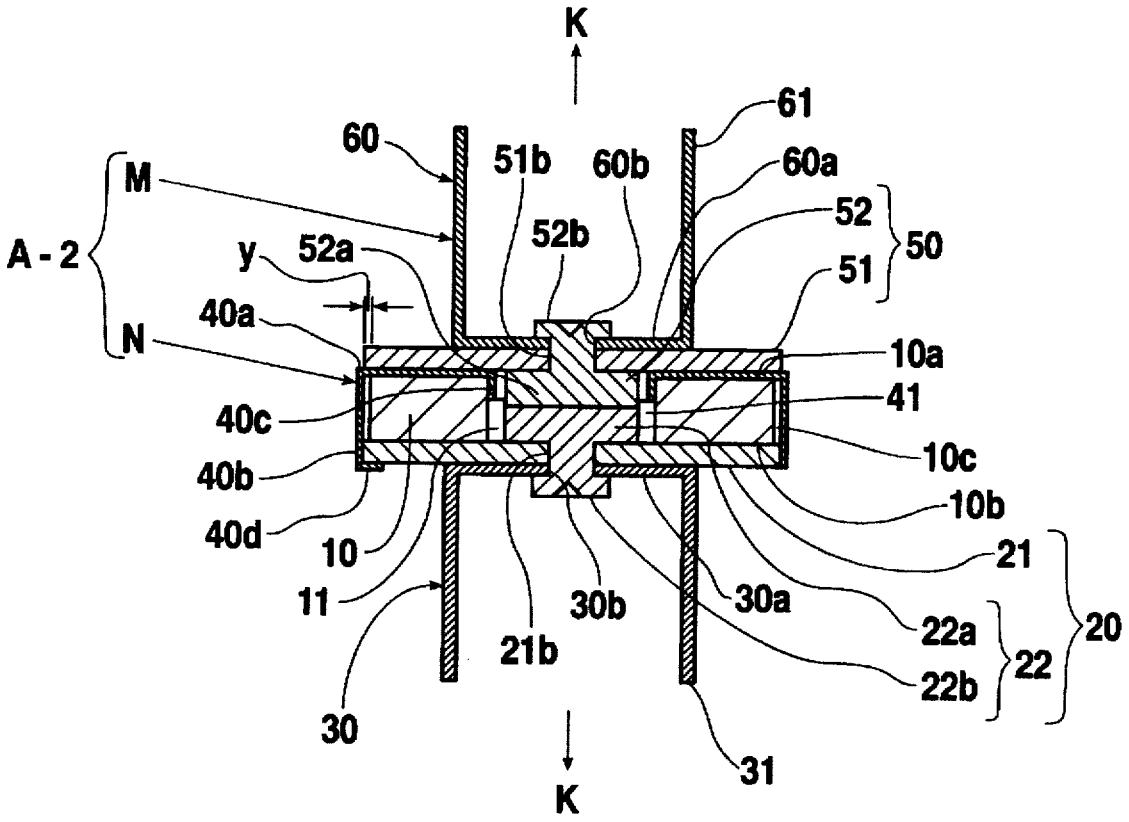
FIG. 7 is a cross section of fastener A-2 at engagement in the second application case.
Figure 8:
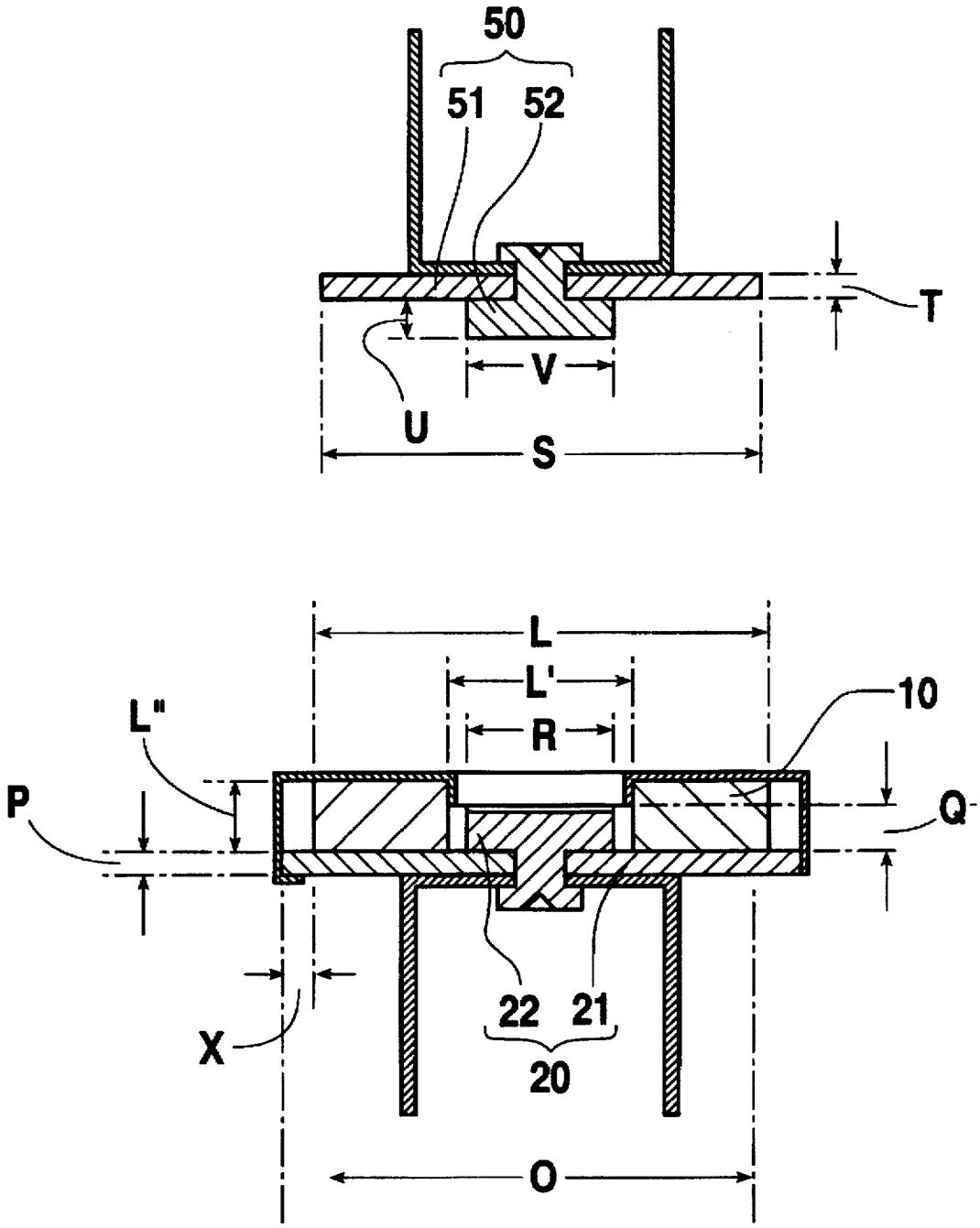
FIG. 8 is a cross section of fastener A-3 at disengagement in the third application case.
Figure 9:
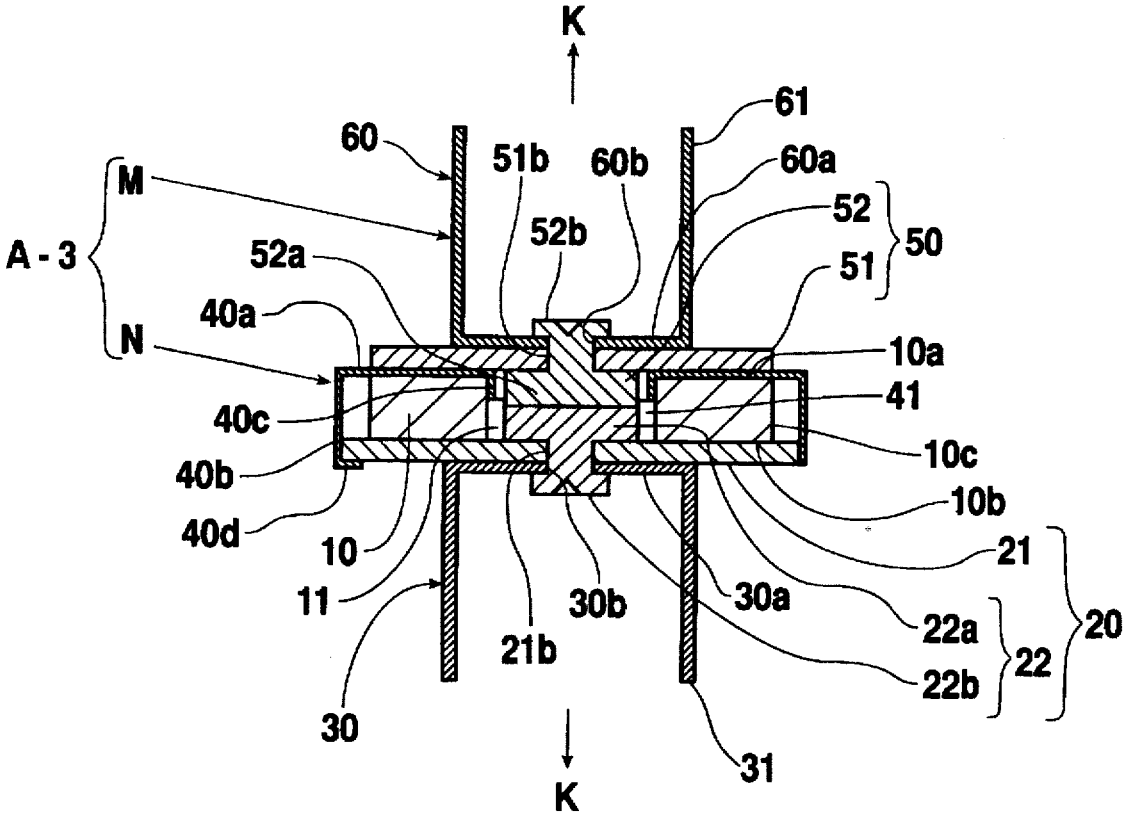
FIG. 9 is a cross section of fastener A-3 at engagement in the third application case.
Figure 10:
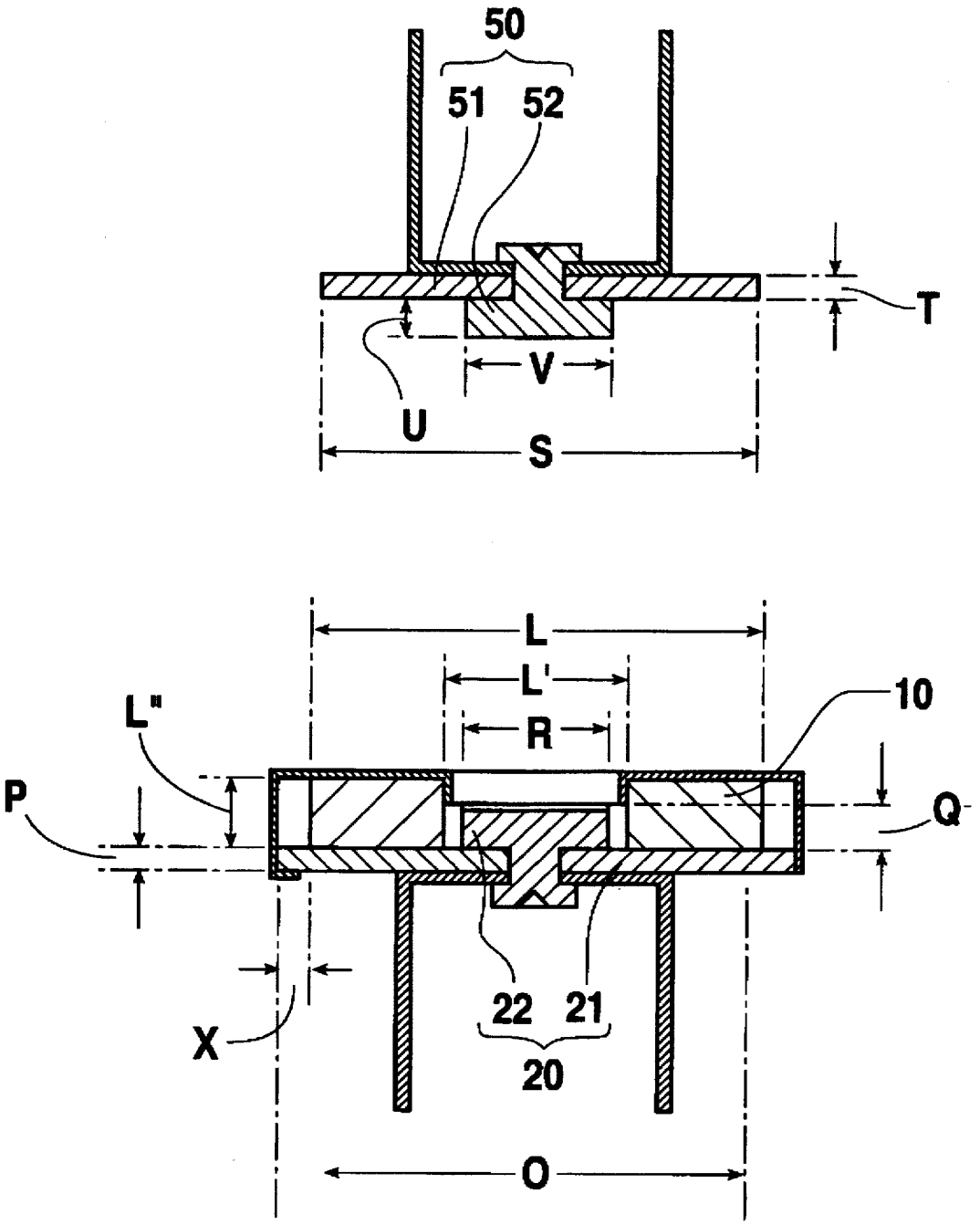
FIG. 10 is a cross section of fastener A-4 at disengagement in the fourth application case.
Figure 11:
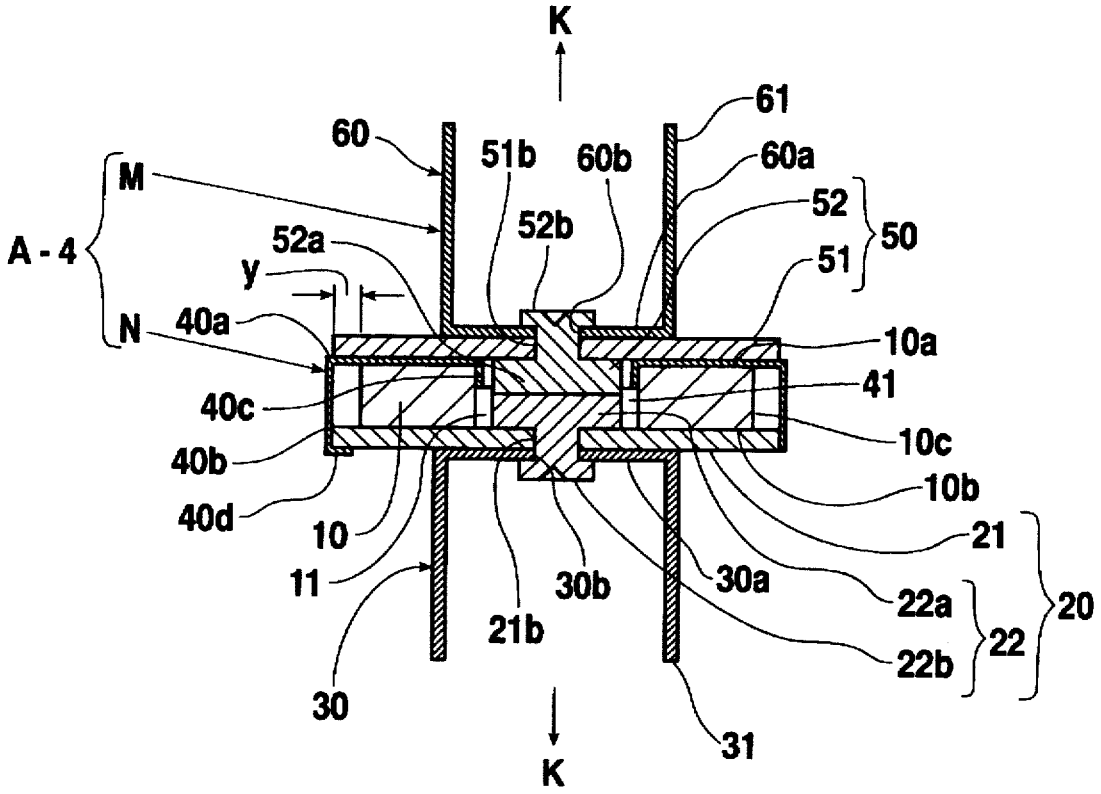
FIG. 11 is a cross section of fastener A-4 at engagement in the fourth application case.
Figure 12:
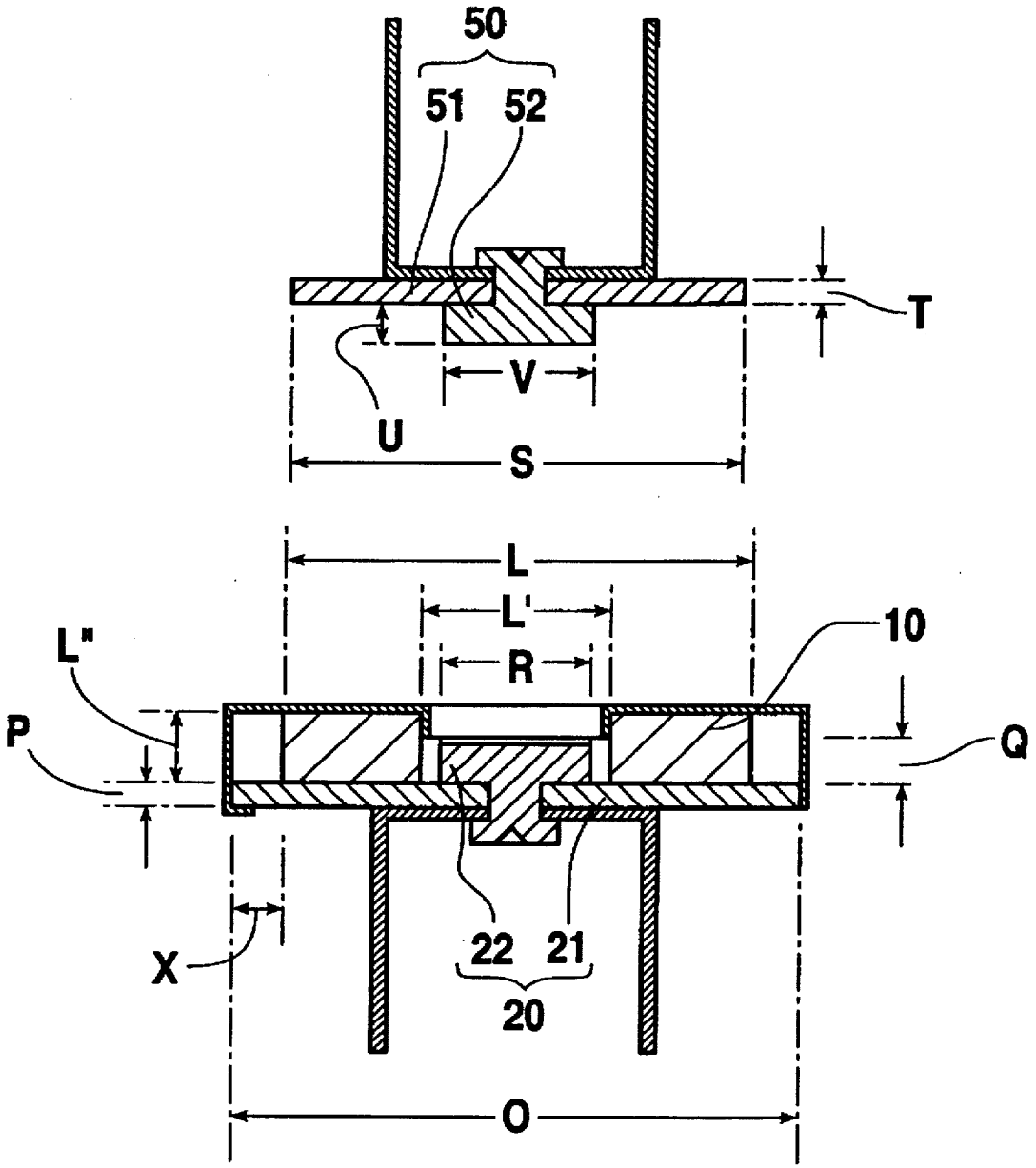
FIG. 12 is a cross section of fastener A-5 at disengagement in the fifth application case.
Figure 13:
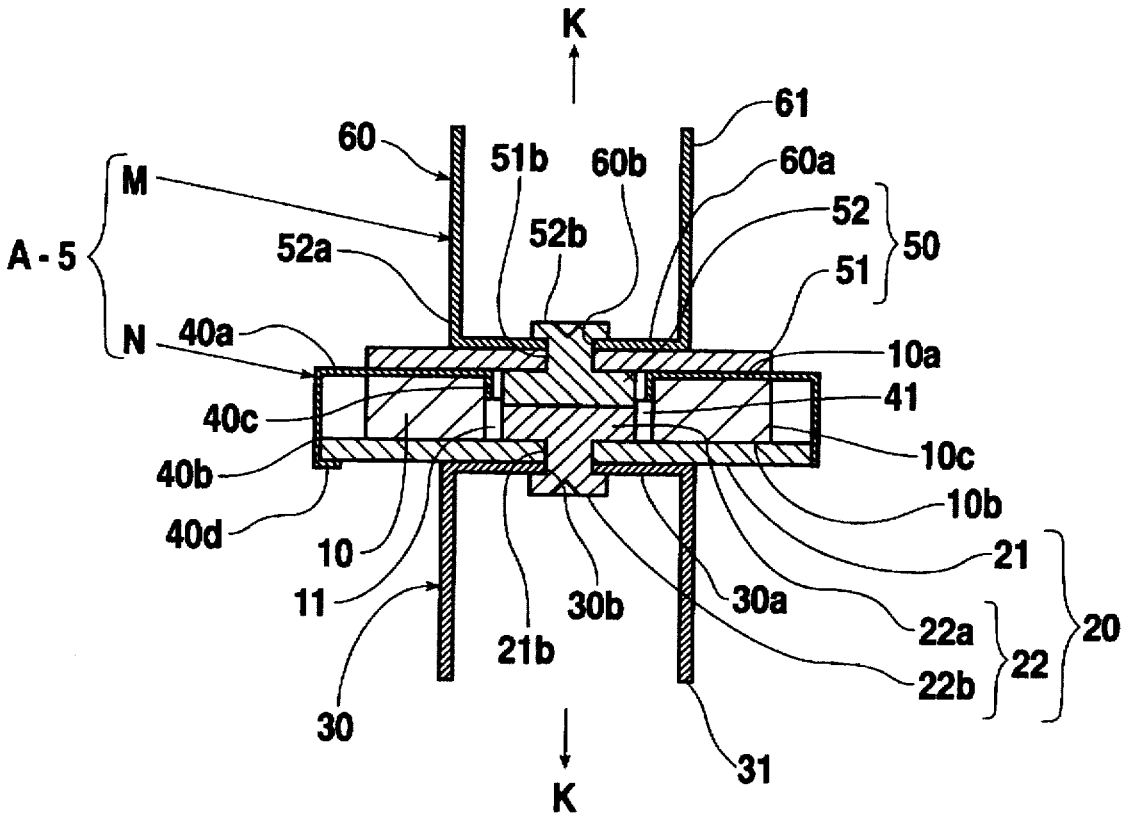
FIG. 13 is a cross section of fastener A-5 at engagement in the fifth application case.
Figure 14:
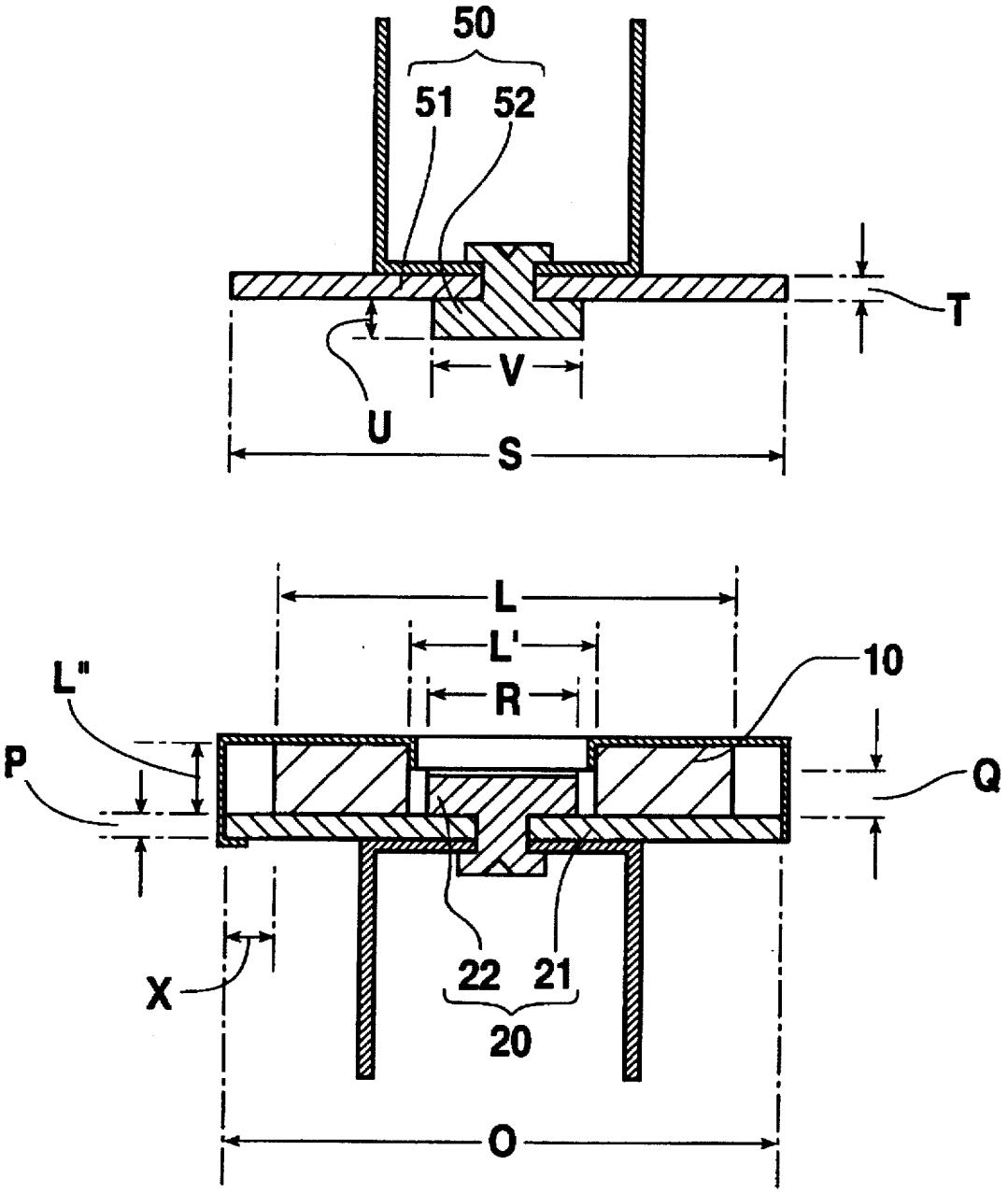
FIG. 14 is a cross section of fastener A-6 at disengagement in the sixth application case.
Figure 15:
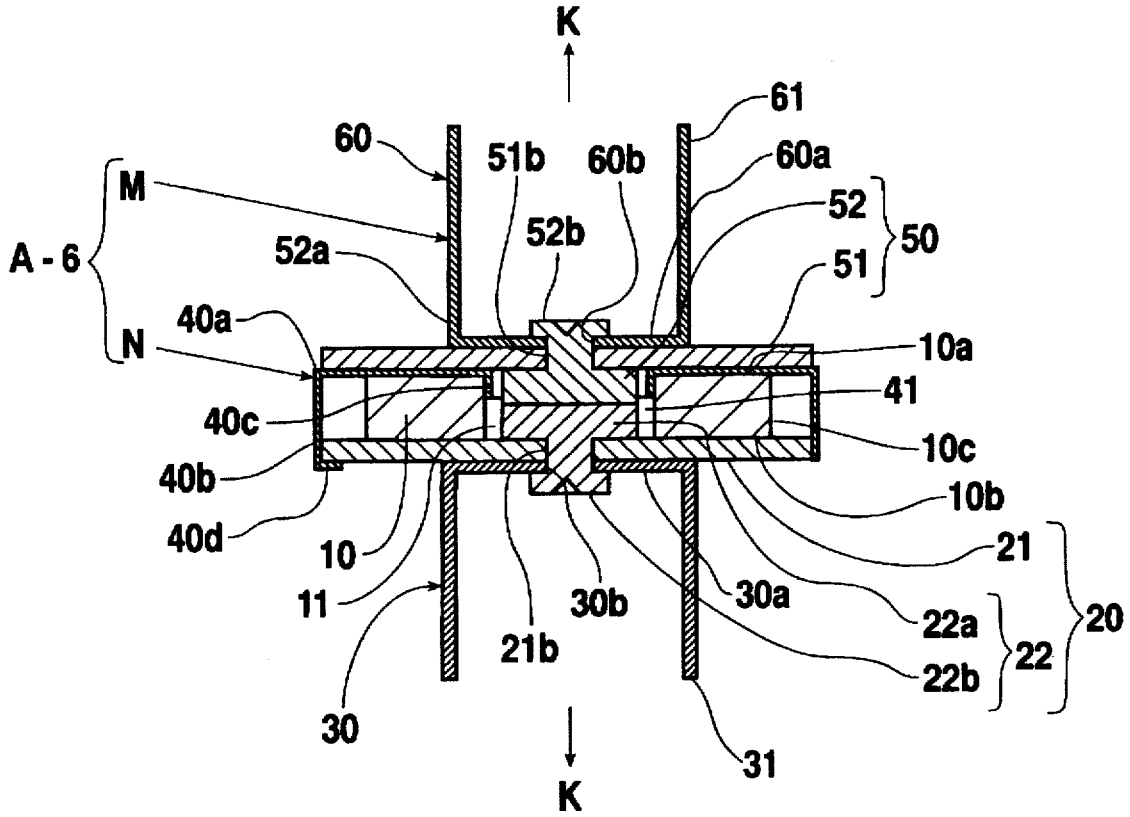
FIG. 15 is a cross section of fastener A-6 at engagement in the sixth application case.

FIG. 4 shows the fastener in test example 1 with the attracted element M and fastening element N unfastened. FIG. 5 shows these elements fastened. FIG. 6 illustrates test example 2 with the fastener unfastened, and FIG. 7 shows the fastener fastened. FIG. 8 shows test example 3 with the fastener unfastened, and FIG. 9 shows the fastener fastened. FIG. 10 shows test example 4 with the fastener unfastened, and FIG. 11 shows the fastener after being fastened. FIG. 12 shows the fastener in test example 5 before being fastened, and FIG. 13 shows the fastener fastened. FIG. 14 shows test example 6 with the fastener unfastened, and FIG. 15 shows the fastener fastened.

Figure 16:
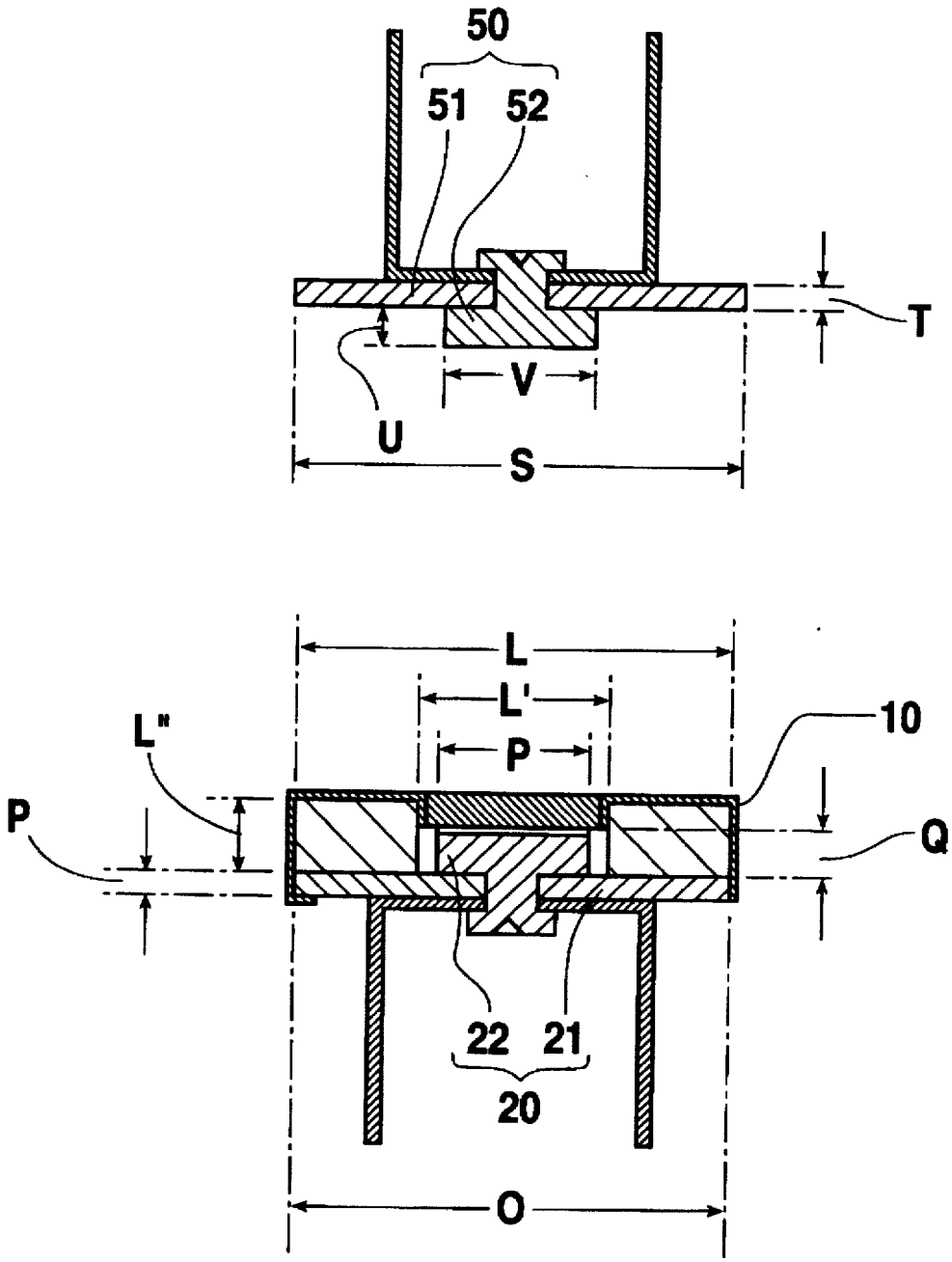
FIG. 16 (PRIOR ART)
FIG. 16 is a cross section of fastener A-7 at disengagement in the first comparative case.
Figure 17:
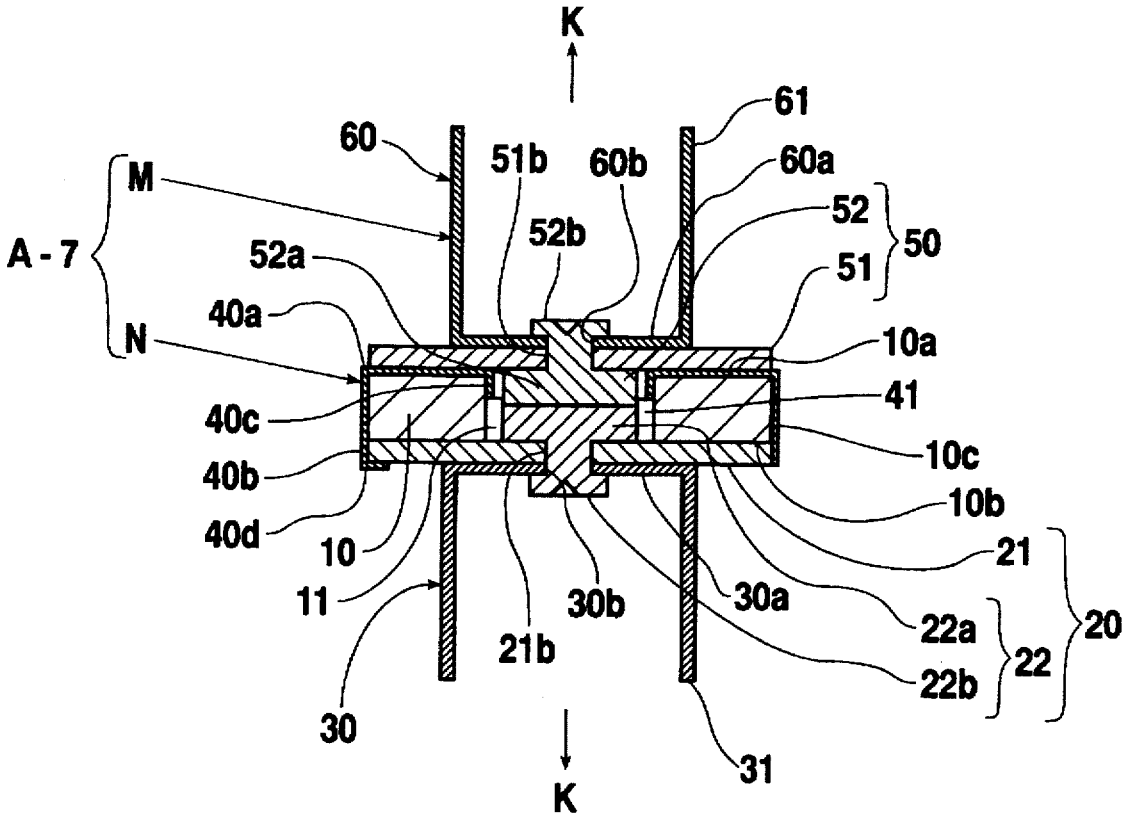
FIG. 17 (PRIOR ART)
FIG. 17 is a cross section of fastener A-7 at engagement in the first comparative case.
Figure 18:
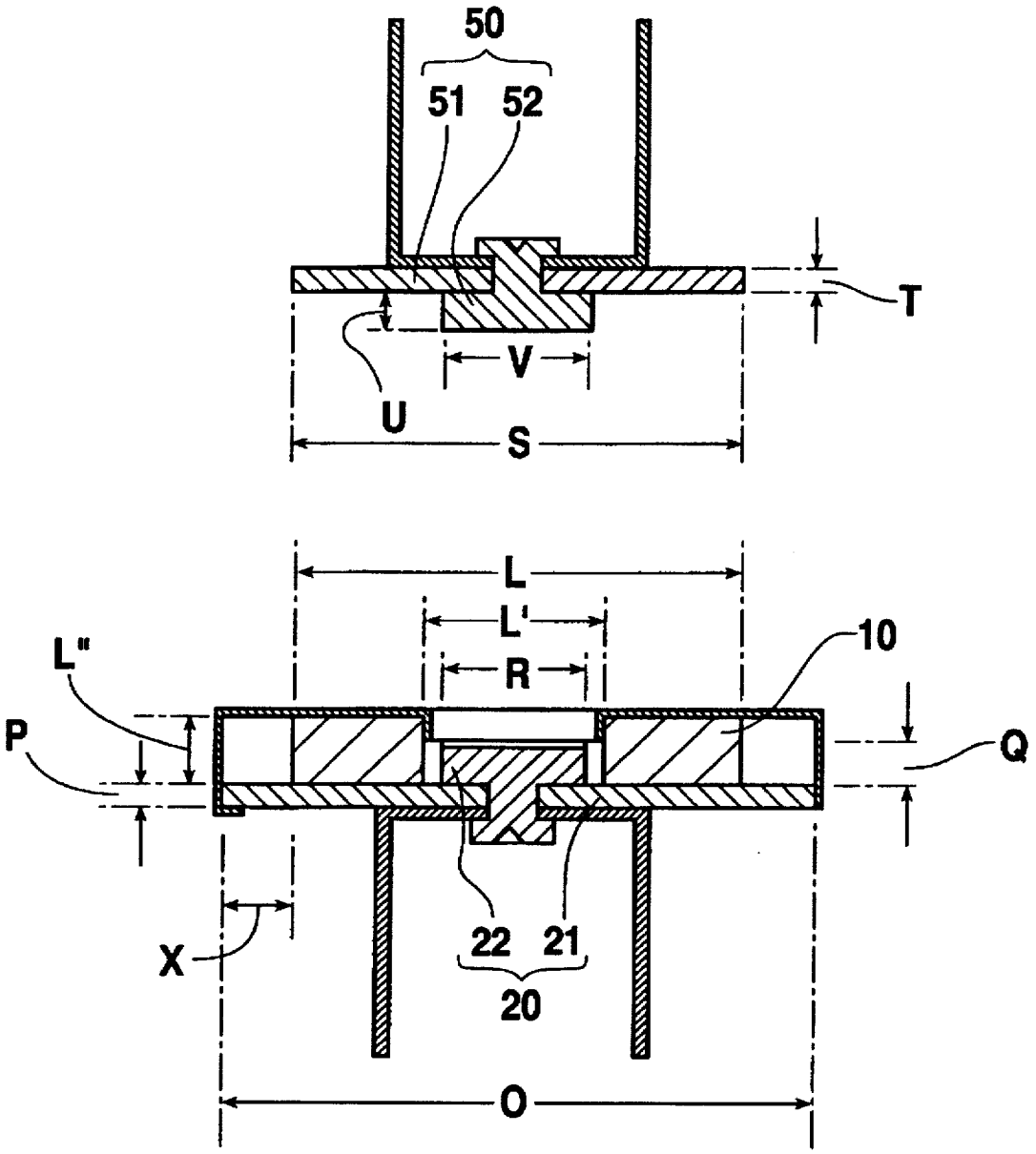
FIG. 18 is a cross section of fastener A-8 at disengagement in the second comparative case.
Figure 19:
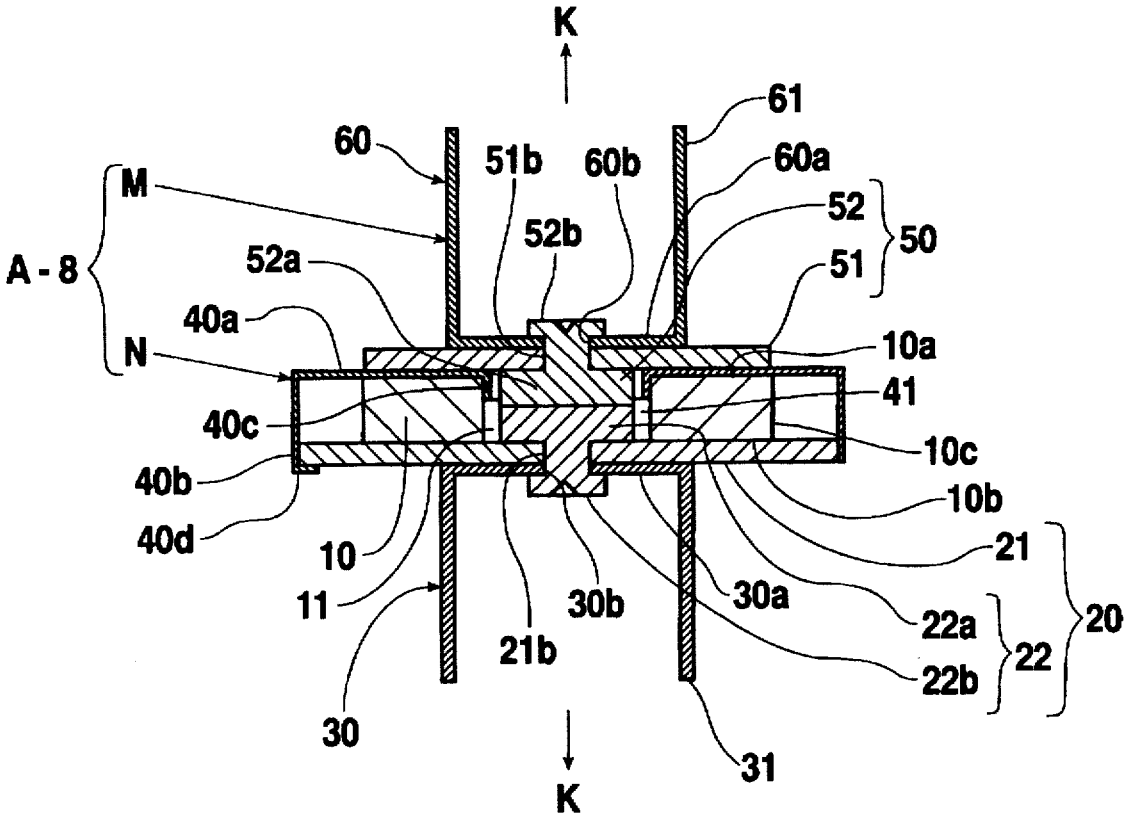
FIG. 19 is a cross section of fastener A-8 at engagement in the second comparative case.
Figure 20:
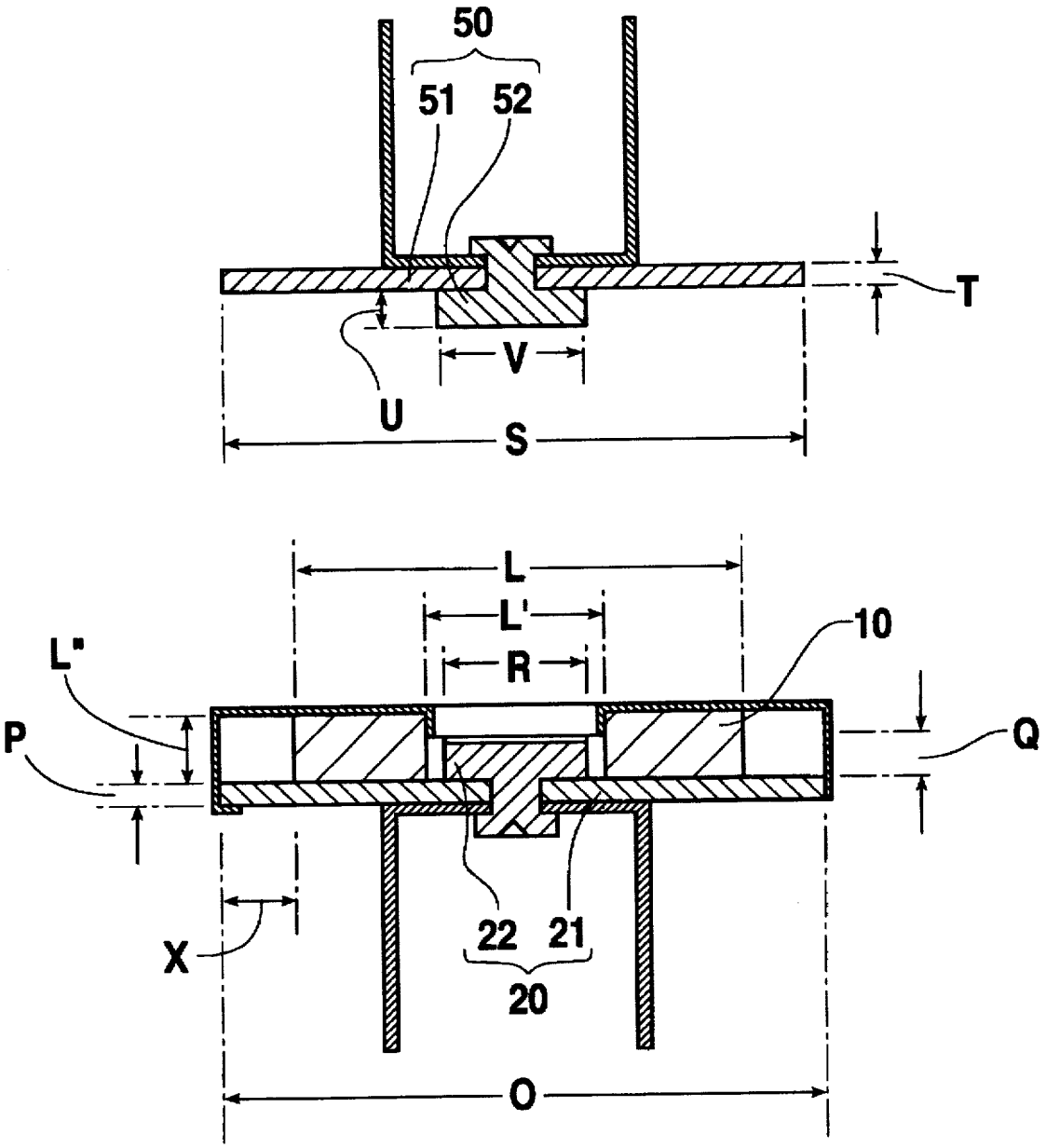
FIG. 20 is a cross section of fastener A-9 at disengagement in the third comparative case.
Figure 21:
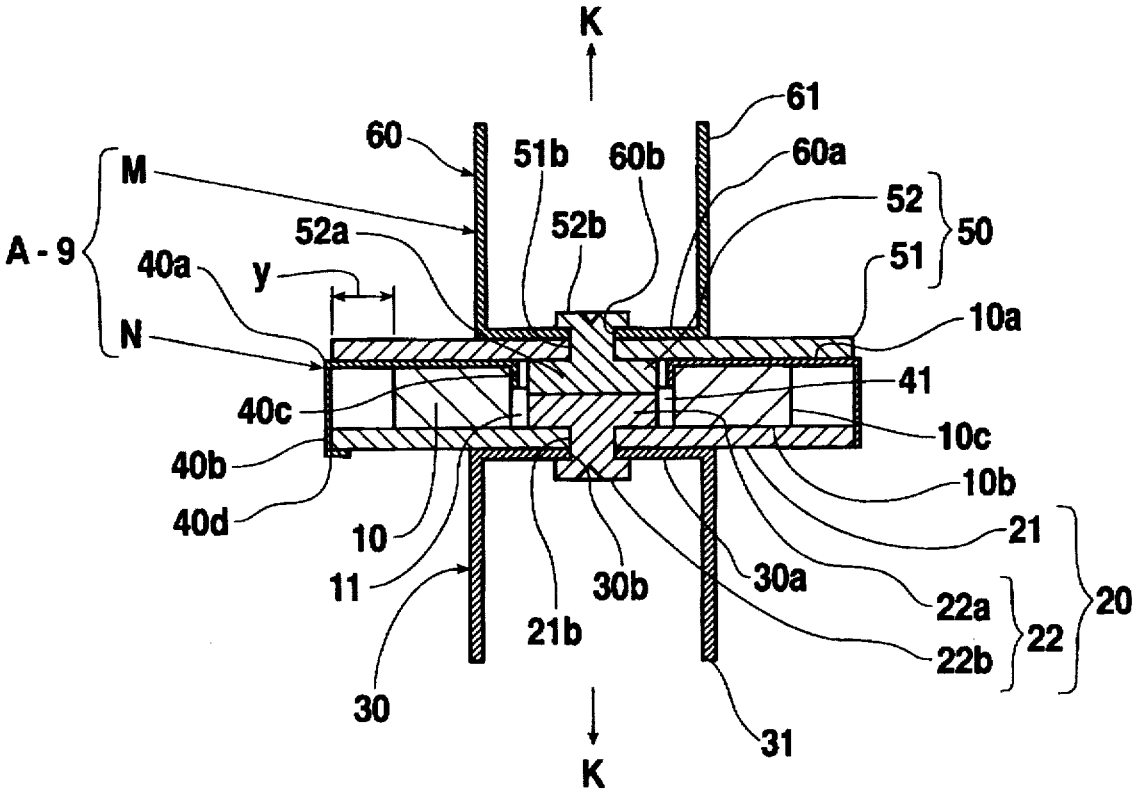
FIG. 21 is a cross section of fastener A-9 at engagement in the third comparative case.

FIG. 16 shows comparison fastener 1 with the fastener unfastened, and FIG. 17 shows the fastener fastened. FIG. 18 shows comparison fastener 2 with the fastener unfastened, and FIG. 19 shows the fastener fastened. FIG. 20 shows comparison fastener 3 with the fastener unfastened, and FIG. 21 shows the fastener fastened.

Figure 3:
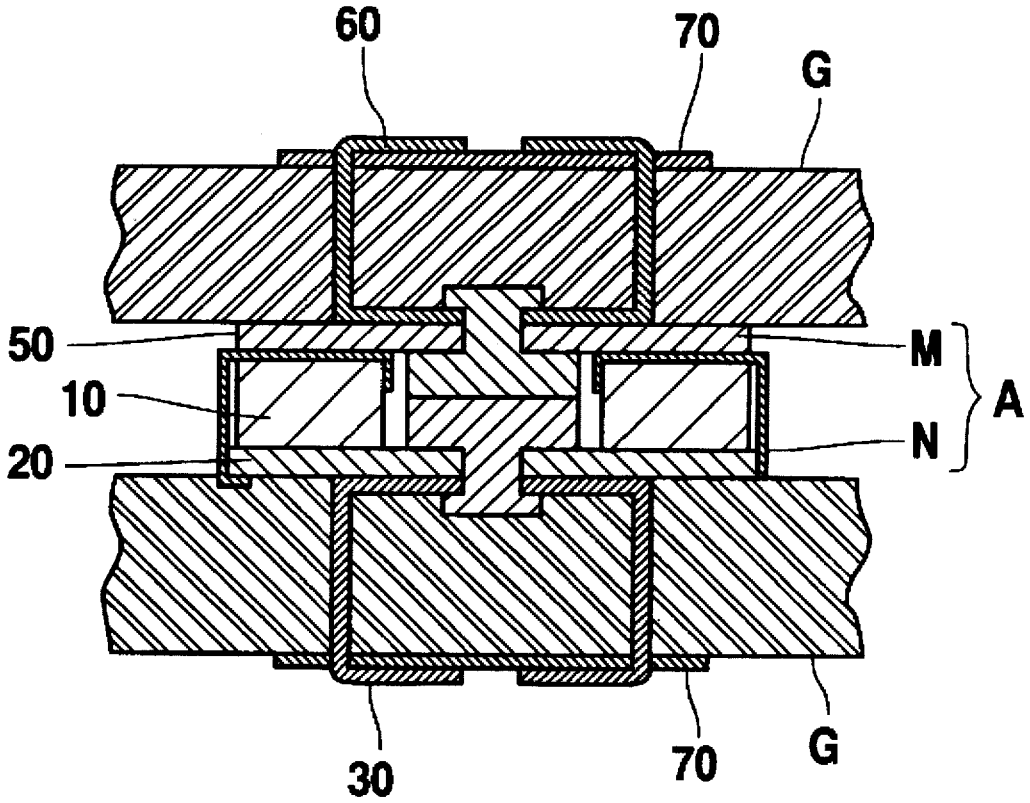
FIG. 3 is a cross section of the fastener A at engagement.

Referring to FIGS. 1–3, general fastener A comprises a fastening element N and an attracted element M. Both fastening element N and attracted element M, as illustrated in FIG. 3, are attached to the object G.

The fastening element N comprises a nonmagnetic case 40, an annular, plate-shaped permanent magnet 10 which has a round hole 11 extending from one magnetic pole surface 10*a* to the other magnetic pole surface 10*b*, a ferromagnetic part 20 attachable to the magnetic pole surface 10*b* of the permanent magnet 10, and an attaching element 30.

The ferromagnetic part 20 comprises a ferromagnetic plate 21, which can be attached to magnetic pole surface 10*b* of permanent magnet 10, and a ferromagnetic rod 22 which extends beyond the ferromagnetic plate 21 and is in the shape of a rod. This ferromagnetic rod 22, includes a smaller diameter rod 22*b* which is to extend through the hole 21*b* provided in the center of the ferromagnetic plate 21 and a short cylinder-shaped, larger diameter rod 22*a*. The larger diameter rod 22*b* of the ferromagnetic rod 22 extends upright into the hole 11 of the permanent magnet 10, and therefore holding the strong magnetic power between the interior of the hole 11 and itself.

The attaching element 30 has a seat plate 30*a*. At the center of the seat plate 30*a*, a hole 30*b* is provided for passing the smaller diameter rod 22*b* of the ferromagnetic rod 22 therethrough. The attaching element 30 further has a pair of legs 31 at either side of the edge facing one another. The attaching element 30 can be either ferromagnetic or non-magnetic.

The ferromagnetic rod 22 can be joined with the ferromagnetic plate 21 by passing the smaller diameter rod 22*b* of the ferromagnetic rod 22 through the hole 21*b* on the ferromagnetic plate 21. The ferromagnetic part 20 thus constructed is then attached to the attaching element 30 by passing the smaller diameter rod 22*b* through the hole 30*b* on the attaching element 30. The protruding part of the smaller diameter rod 22*b* extending beyond the seat plate 30 is pressed against the seat plate 30*a* to form one piece, as shown in FIGS. 1–3.

The case 40, made of non-magnetic material, has a round-shaped hole 41 located at the center of the round-shaped case top plate 40*a*. The round-shaped hole 41 is provided with a flange 40*c* hanging perpendicularly from the top plate 40*a*. Moreover, the case side 40*b* has prongs 40*d* extending downwardly.

When assembling the fastening element N, the magnetic pole surface 10*a* of the permanent magnet 10 is made in contact with the interior case top 40*a* of the case 40 and the flange 40*c* of the case 40 is in contact with the interior wall of the hole 11 of the permanent magnet 10. Then, the ferromagnetic part 20 connected with the attaching element 30 is inserted into the case 40, so that the ferromagnetic rod 22 of the ferromagnetic part 20 protrudes inside the hole 11 of the permanent magnet 10, and the ferromagnetic plate 21 of the ferromagnetic part 20 faces the magnetic pole surface 10*b* of the permanent magnet 10. Finally, the prongs 40*d* are bent toward the ferromagnetic plate 21 so that all these parts are held together in the case 40.

The attracted element M comprises a ferromagnetic part 50 having a ferromagnetic rod 52 and a ferromagnetic plate 51, similar to the ferromagnetic part 20 on the fastening element N. Such ferromagnetic part 50 is adapted to be kept in contact with or to be very close to the fastening element N on the side opposite to the ferromagnetic part 20 as described hereinafter. The attracted element M further comprises an attaching element 60 attached to a ferromagnetic part 50 with the rod 52. The attaching element 60 has a pair of legs 61 located at the edge of the seat plate 60*a* facing each other.

The attracted element M is constructed as follows: the smaller diameter rod 52*b* of the ferromagnetic rod 52 passes through the hole 51*b* on the ferromagnetic plate 51 till the short-round-shaped larger diameter rod 52*a* of the ferromagnetic rod 52 contacts one side of the ferromagnetic plate 51. The seat plate 60*a* of the attaching element 60 is made in contact with the other side of the ferromagnetic plate 51, and the smaller diameter rod 52*b* passes through the hole 60*b* on the seat plate 60*a*. The end of the smaller diameter rod 52*b*, protruding from the seat plate 60*a*, is pressed into the seat plate 60*a*.

The fastening element N and the attracted element M constructed as described hereinabove are to be attached to portions of object G through the legs 31 and 61 provided on the attaching elements 30 and 60, respectively as shown in FIGS. 1–3. The legs 31 and 61 are inserted through the object G, and then through a washer 70. The fastening element N and the attracted element M can be securely attached to the object G by bending the legs 31 and 61 against the washer 70.

The structures of each test example shown in FIGS. 4–21 has both the fastening element N and the attracted element M equipped with ferromagnetic rods 22 and 52 respectively. However, it is equally acceptable to construct a fastener in which only the fastening element N has a rod. Such a rod can directly attach to either the ferromagnetic plate 51 of the attracted element M or the ferromagnetic plate 21 of the fastening element N.

Test examples shown in FIGS. 4–15 and comparison fasteners shown in FIGS. 18–21 contain an extension "x" disposed on plate 21, which overlaps the permanent magnet, or an extension "y" disposed between plate 51, which overlaps the permanent magnet. Overlaps "x" and "y" allow plates 21 and 51 to capture at least some of the magnetism from the permanent magnet that would otherwise be lost.

The extension x of the ferromagnetic part 20 may cover the entire circle of the ferromagnetic part 20, or only a part of it. Likewise, extension y of the ferromagnetic part 50 can be over the entire circle of the ferromagnetic part 20 or only a part of it.

In the test structures shown below, the width of extensions x and y are varied to determine the optimal range. As evidenced by the data below, the extensions x and y extending beyond the edge of the permanent magnet 10 of the fastener A should be no less than 0.1 mm but should not exceed 2.0 mm, for a permanent magnet having 18 mm in diameter.

The fastener of the present invention exhibits the above described characteristics. In particular, the use of the magnetism generated by the permanent magnet 10 on the fastener A is significantly improved through the following arrangements:

engaging the fastening element N and attracted element M;

extending the outer rim of the ferromagnetic part 20 of the fastening element N over beyond the magnetic pole side surface of **10*b* of the permanent magnet 10 of 18 mm in diameter for an extension of no less than 0.1 mm but no more than 2.0 mm; and extending the outer rim of the ferromagnetic part 50 of the attracted element M from the magnetic surface 10*a* of the permanent magnet 10** of 18 mm in diameter for an extension of no less than 0.1 mm but no more than 2.0 mm.

(1) Fastener in Comparison Model 1

Comparison model fastener A (hereinafter "fastener A-7") has its ferromagnetic part 20 and permanent magnet 10 constructed as follows:

1-1. The permanent magnet 10 is made of a ferrite magnet in a round-plate shape with its exterior diameter L set to 18.0 mm, interior diameter L' set to 7.5 mm, and its thickness L" set to 3.0 mm.

1-2. The ferromagnetic part 20 including a ferromagnetic plate 21 and a ferromagnetic rod 22 is constructed as one piece.

1-2-1. The round plate 21 is made of ferromagnetic material with its diameter O set to 18.0 mm and its thickness P set to 1.0 mm.

1-2-2. The ferromagnetic rod 22 is made of short cylinder-shaped ferromagnetic material having its diameter R set to 6.0 mm and its height Q set to 1.65 mm.

2. The ferromagnetic part 50 of the attracted element M of the fastener A-7 illustrated in this first comparison has the following characteristics:

2-1. The ferromagnetic part 50 comprising a ferromagnetic plate 51 and a ferromagnetic rod 52 is constructed as one piece.

2-1-1. The ferromagnetic round plate 51 has its diameter S set to 18.0 mm and its thickness T set to 1.0 mm.

2-1-2. The ferromagnetic rod 52 is short cylinder-shaped and made of a ferromagnetic material having its diameter V set to 6.0 mm and its height set to 1.65 mm.

As a result, the ferromagnetic element 20 for the fastening element N fits inside the magnetic pole side **10*b* of permanent magnet 10. The cylindrical outer wall 10*c* of the permanent magnet 10 and the outside surface of the ferromagnetic part 20 form an almost continuous surface. Further, the ferromagnetic part 50 of the attracted element M is constructed to fit inside the magnetic pole surface 10*a* of permanent magnetic 10, so that the outside pole of ferromagnetic part 50 and the cylindrical wall 10*c* of the permanent magnet 10** also form a substantially continuous surface.

The fastener A-7 used in this first comparison is made the same, or practically the same as fastener previously discussed, and for parts that are same or practically same, the same numeral references are used and the explanation is omitted.

The fastening element N of fastener A-7 in the first comparative example and the attracted element M are fastened as shown in FIG. 17. When one of the fastening element N and the attracted element M is fixed at a given place, the other element can be pulled in the direction of an arrow indicated in FIG. 17 to release the fastener. The weight required to pull the element when the fastening element N and the attracted element M are being detached can be measured. The weight applied when fastening element N and attracted element M are being detached is recorded below.

| | |
|---|---|
| Weight when disengaged the first time | 3450 g |
| Weight when disengaged the second time | 3400 g |
| Weight when disengaged the third time | 3400 g |
| Weight when disengaged the fourth time | 3350 g |
| Weight when disengaged the fifth time | 3400 g |

(2) The fastener in the first test example

Fastener A of the first test example (hereinafter "fastener A-1") as shown in FIGS. 4 and 5 will be explained. In order to simplify the comparison, the fastener A-1 used in the first test example employs basically the same components as in the first comparative example A-7 discussed hereinabove. Different parts are used in faster A-1 only when they are needed.

For fastener A-1 in the first test example, the ferromagnetic plate 21 on the ferromagnetic part 20 of the fastening element N has its diameter O set to 18.2 mm and its thickness P set to 1.0 mm. The fastener A-1 has the same structure and parts as the fastener A-7 in the first comparative example discussed hereinabove except for the case 40 for accommodating the ferromagnetic plate 21.

The fastener A-1 used in this first test example is the same, or practically the same as the fastener A previously discussed. For parts that are the same, or practically the same, same numeral references are used and the explanation is omitted.

According to the fastener A-1 used in the first test example, the ferromagnetic part 20 of the fastening element N is constructed so that the peripheral **21*a* extends beyond the magnetic pole surface 10*b* of the permanent magnet 10** for a protrusion x set to 0.1 mm.

By using the same method with fastener A-1 in the first test example discussed hereinabove, the fastening element N and the attracted element M of the fastener A-1 in the first test example are tested for the weight required to separate the two elements. The results are as follows:

| | |
|---|---|
| Weight when disengaged the first time | 3600 g |
| Weight when disengaged the second time | 3600 g |
| Weight when disengaged the third time | 3600 g |
| Weight when disengaged the fourth time | 3500 g |
| Weight when disengaged the fifth time | 3550 g |

The average weight applied when the fastening element N is being detached from the attracted element M is 3570 g. The attaching/pulling power, compared with that of the fastener A-7 used in the first comparative example, increases about 5%.

(3) The fastener in the second test example

Fastener A used in the second test example (hereinafter "Fastener A-2") shown in FIGS. 6 and 7 will be explained. In order to simplify the comparison, the fastener A-2 used in the second test example employs basically the same components in the first comparative example A-7. Different parts are used only when they are needed for illustrating a different structure.

According to the fastener A-2 in the second test example, the ferromagnetic plate 21 of the ferromagnetic part 20 of the fastening element N has a diameter O of 18.2 mm, and a width P of 1.0 mm. Fastener A-2 has the same structure as the fastener A-7 in the first comparative example except for the case 40 for accommodating the ferromagnetic plate 21. Moreover, the ferromagnetic plate 51 of the ferromagnetic part 50 of the attracted element M has its diameter S set to 18.2 mm and its width P set to 1.0 mm.

The fastener A-2 used in this second test example is the same or practically the same as the fastener A discussed hereinabove. For parts that are the same or practically the same, same numeral references are used and explanation is omitted.

Therefore, for fastener A-2 used in the second test example, the ferromagnetic part 20 of the fastening element N has its side surface 21*a* extending beyond the magnetic pole 10*b* of the permanent magnet 10 for a protrusion x set to 0.1 mm. In addition, the ferromagnetic part 50 of the attracted element M has its side surface 51*a* extending beyond the magnetic pole surface 10*a* of the permanent magnet 10 for a protrusion y set to 0.1 mm.

By using the same method with fastener A-1 in the first test example discussed hereinabove, the fastening element N and the attracted element M of the fastener A-2 are tested for the weight required to pull the two elements apart. The results are as follows:

| | |
|---|---|
| Weight when disengaged the first time | 3850 g |
| Weight when disengaged the second time | 3750 g |
| Weight when disengaged the third time | 3850 g |
| Weight when disengaged the fourth time | 3800 g |
| Weight when disengaged the fifth time | 3800 g |

The average weight when the fastening element N in test example 2 is being detached from the attracted element M is 3820 g. Such attaching power, compared with the fastener A-7 in the first comparative example, increases about 12.35%.

(4) The fastener in the third test example

Fastener A used in the third test example (hereinafter "Fastener A-3") as shown in FIGS. 8 and 9 will be explained. In order to simplify the comparison, the fastener A-3 in the third test example employs basically the same components as in the first comparative example A-7. Different parts are used only when they are needed to illustrate a different structure of the fastener A-3.

According to the fastener A-3 in the third test example, the ferromagnetic plate 21 of ferromagnetic part 20 of the fastening element N has a diameter O set to 20.6 mm, and a thickness P set to 1.0 mm. The fastener A-3 has the same structure as the fastener A-7 in the first comparative example except for the case 40 for accommodating the round plate 21.

The fastener A-3 in the third test example is the same or practically the same as the fastener A previously discussed. For parts that are the same or practically the same, same numeral references are used and the explanation is omitted.

Therefore, for fastener A-3 in the third test example, the ferromagnetic part 20 of the fastening element N has a side surface 21*a* extending beyond the magnetic pole surface 10*b* of the permanent magnet 10 for a protrusion x of 1.3 mm.

By using the same method as used for the fastener A-1 in the first test example, the fastening element N and the attracted element M of the fastener A-3 in the third test example are tested for the weight required to detach the fastening element N from the attracted element M. The test results are as follows:

| | |
|---|---|
| Weight when disengaged the first time | 3650 g |
| Weight when disengaged the second time | 3700 g |
| Weight when disengaged the third time | 3750 g |
| Weight when disengaged the fourth time | 3650 g |
| Weight when disengaged the fifth time | 3700 g |

The average weight when the fastening element N in test example 3 is being detached from the attracted element M is 3690 g. Such attaching power, compared with the fastener A-7 in the first comparative example, increases about 8.53%.

(5) The fastener in the fourth test example

Fastener A used in the fourth test example (hereinafter "fastener A-4") as shown in FIGS. 10 and 11 will be explained. In order to simplify the comparison, the fastener A-4 in the fourth test example employs basically the same components as in the first comparative example A-7. Different parts are used for the fastening element A-4 only when they are needed to illustrate a different structure.

According to the fastener A-4 in the fourth test example, the ferromagnetic plate 21 of ferromagnetic part 20 of the fastening element N has a diameter O of 20.6 mm, and a width P of 1.0 mm. The fastener A-4 has substantially the same structure as the fastener A-7 in the first comparative example. The exceptions are for the non-magnetic case 40 which is constructed to accommodate the ferromagnetic plate 21 and the ferromagnetic plate 51 of the ferromagnetic part 50 of the attracted element M which has a diameter S of 20.6 mm and a width P of 1.0 mm.

The fastener A-4 used in this fourth test is the same or practically the same as the fastener A previously discussed. For parts that are the same or practically the same, same numeral references are used and the explanation is omitted.

Therefore, for the fastener A-4 in the fourth test example, the ferromagnetic part 20 of the fastening element N has a side surface 21*a* extending beyond the magnetic pole surface 10*b* of the permanent magnet 10 for a protrusion x of 1.3 mm. In addition, the ferromagnetic part 50 of the attracted element M has a side surface 51*a* extending beyond the magnetic pole surface 10*a* of permanent magnet 10 for a protrusion y of 1.3 mm.

By using the same method applied to the fastener A-1 in the first test example, the fastening element N and the attracted element M of the fastener A-4 are tested. The results of the weight when the fastening element N is being detached from the attracted element M are as follows:

| | |
|---|---|
| Weight when disengaged the first time | 4000 g |
| Weight when disengaged the second time | 3950 g |
| Weight when disengaged the third time | 3900 g |
| Weight when disengaged the fourth time | 3900 g |
| Weight when disengaged the fifth time | 3950 g |

The average weight when the fastening element N in test example 4 is being detached from the attracted element M is 3940 g. Such attaching power, compared with the fastener A-7 in the first comparative example, increases about 15.88%.

(6) The fastener in the fifth test example

Fastener A used in the fifth test example (hereinafter "fastener A-5") as shown in FIGS. 12 and 13 will be explained. In order to simplify the comparison, the fastener A-5 in the fifth test example has basically the same components as in the first comparative example A-7. Different parts are used for the fastener A-5 only when they are needed for illustrating a different structure.

According to the fastener A-5 in the fifth test example, the ferromagnetic plate 21 of the ferromagnetic part 20 of the fastening element N has a diameter O set to 22.0 mm and a width P set to 1.0 mm. The fastener A-5 has the same structure as the fastener A-7 in the first comparative example except for the case 40 for accommodating the round plate 21.

The fastener A-5 in this fifth test example is the same or practically the same, in essence, as the fastener A previously discussed. For parts that are the same or practically the same, same numeral references are used and the explanation is omitted.

Therefore, for the fastener A-5 in the fifth test example, the ferromagnetic part 20 of the fastening element N has a side surface 21*a* extending beyond the magnetic pole surface 10*b* of the permanent magnet 10 for a protrusion x of 2.0 mm.

By using the same method applied to the fastener A-1 in the first test, the fastening element N and the attracted element M of the fastener A-5 are tested. The results of the weight when the fastening element N is being detached from the attracted element M are as follows:

| | |
|---|---|
| Weight when disengaged the first time | 3600 g |
| Weight when disengaged the second time | 3700 g |
| Weight when disengaged the third time | 3700 g |
| Weight when disengaged the fourth time | 3650 g |
| Weight when disengaged the fifth time | 3650 g |

The average weight when the fastening element N in test example 5 is being detached from the attracted element M is 3660 g. Such attaching power, compared with the fastener A-7 in the first comparative example, increases about 7.65%.

(7) The fastener in the sixth test example

Fastener A used in the sixth test example (hereinafter "fastener A-6") as shown in FIGS. 14 and 15 will be explained. In order to simplify the comparison with the fastener A, the fastener A-6 in the sixth test example has basically the same components as in the first comparative example A-7. Different parts are used for the fastener A-6 only when a different structure is employed.

According to the fastener A-6 in the sixth test example, the ferromagnetic plate 21 of the ferromagnetic part 20 of the fastening element N has a diameter O of 22.0 mm, and a width P of 1.0 mm. The fastener A-6 has substantially the same structure as fastener A-7 in the first comparative example. The exceptions are for the non-magnetic case 40 for accommodating the ferromagnetic plate 21 and the ferromagnetic plate 51 of the ferromagnetic part 50 of the attracted element M which has a diameter S of 22.0 mm and a width P of 1.0 mm.

The fastener A-6 in the sixth test example is the same or practically the same as the fastener A previously discussed. For parts that are the same or practically the same, same numeral references are used and the explanation is omitted.

Therefore, for fastener A-6 in the sixth test example, the ferromagnetic part 20 of fastening element N has a side surface 21*a* extending beyond the magnetic pole surface 10*b* of the permanent magnet 10 for a protrusion x of 2.0 mm. In addition, the ferromagnetic part 50 of the fastening element M has a side surface 51*a* extending beyond the magnetic pole surface 10*a* of the permanent magnet 10 for a protrusion y of 2.0 mm.

By using the same method as applied to the fastener A-1 in the first test discussed hereinabove, the fastening element N and the attracted element M of the fastener A-6 are tested. The results of the weight when the fastening element N is being detached from the attracted element M are as follows:

| | |
|---|---|
| Weight when disengaged the first time | 3850 g |
| Weight when disengaged the second time | 3800 g |
| Weight when disengaged the third time | 3800 g |
| Weight when disengaged the fourth time | 3900 g |
| Weight when disengaged the fifth time | 3850 g |

The average value of the measured load at disengagement of the fastening element N from the attracted element M for the faster A-6 in the sixth test example is 3850 g. The results demonstrate that the attraction is increased approximately by 13.24% compared to the faster A-7 in the first comparative example.

(8) Fastener in comparison 2

The faster A in the second comparative test (hereinafter "fastener A-8") as shown in FIGS. 18 and 19 will be explained. In order to simplify the comparison with the fastener A, the fastener A-8 used in the second comparative test example has basically the same components as in the first comparative example A-7. Different parts are used for the fastener A-6 only when a different structure is employed.

The ferromagnetic plate 21 of the ferromagnetic element 20 of the fastening element N of the faster A-8 in the second comparative test has a diameter of 24.0 mm and a thickness of 1.0 mm. The fastener A-8 has substantially the same components as fastener A-7 described hereinabove in the first comparative example except for the non-magnetic case 40 covering the ferromagnetic plate 21.

The structure of the fastener A-8 in the second comparative test is identical, except as noted above, to that of the fastener A. Same numeral references are used for the same parts and the explanation is omitted.

The side surface 21*a* of the ferromagnetic part 20 of the fastener A-8 in the second comparative test 10 extends outwardly beyond the magnetic pole surface 10*b* of the permanent magnet 10 for an extension x which is set to 3 mm.

By using the same method applied to the fastener A-1 in the first test example discussed hereinabove, the fastening element N and the attracted element M of the fastener A-8 are tested. The weight required when the fastening element N is being detached from the attracted element M is as follows:

| | |
|---|---|
| Weight when disengaged the first time | 3400 g |
| Weight when disengaged the second time | 3500 g |
| Weight when disengaged the third time | 3500 g |
| Weight when disengaged the fourth time | 3450 g |
| Weight when disengaged the fifth time | 3500 g |

The mean value of the measured load at detachment of the fastening element N from the attracted element M for the fastener A-8 in the second comparative test is 3470 g. Such results demonstrate that the attraction power is increased for about 2%, compared with the fastener A-7 in the first comparative test.

(9) Fastener in comparison 3

The faster A in the comparative test 3 (hereinafter "fastener A-9") as shown in FIGS. 20 and 21 will be explained. In order to simplify the comparison with the fastener A, the fastener A-9 in the third comparative test has the same components as those in the fastener A-7 in the first comparative test previously described. Different components are used only when different structure/components are employed.

According to the fastener A-9 in the third comparative test, the ferromagnetic plate 21 of the ferromagnetic part 20 of the fastening element N has a diameter O of 24 mm and a thickness P of 1.0 mm. The non-magnetic case 40 is constructed to accommodate the ferromagnetic plate 21. The ferromagnetic plate 51 of the ferromagnetic part 50 of the attracted element M has a diameter S of 24.0 mm and a thickness P of 1.0 mm. All the remaining components are made identical to those in the fastener A-7 of the first comparative test.

The structure of the A-9 in this third comparative example is identical, with the exception of those points mentioned above, to that of the fastener A, and the same part identification numbers are used without repeating explanations for each.

The side surface 21*a* of the ferromagnetic part 20 of the fastener A-9 in the third comparative test extends beyond the magnetic pole surface 10*b* of the permanent magnet 10 for an extension x of 3 mm. Further, the side surface 51*a* of ferromagnetic part 50 of the attracted element M extends beyond the magnetic pole surface 10*a* of the permanent magnet 10 of the fastening element N for an extension of 3 mm.

By using the same method as applied to the fastener A-7 in the first comparative test previously described, the fastener A-9 in the third comparative test is tested and the weight required to disengage the fastening element N from the attracted element M is as follows:

| | |
|---|---|
| Weight when disengaged the first time | 3400 g |
| Weight when disengaged the second time | 3450 g |
| Weight when disengaged the third time | 3450 g |
| Weight when disengaged the fourth time | 3400 g |
| Weight when disengaged the fifth time | 3450 g |

The mean value of the measured weight at detachment of the fastening element N from the attracted element M for the fastener A-9 in the third comparative test is 3410 g. Such results demonstrate that the attraction has slightly increased by 0.3%, compared with the fastener A-7 in the first comparative test. Therefore, there is no significant difference between the traditional model and this comparative test.

Thus, as shown by these tests the optimal width for extensions x and y is between 0.1 mm and 2 mm for a magnet having an 18 mm diameter (9 mm radius). Thus the optimal ratio between the radius of the ferromagnetic plate 51 and the radius of the permanent magnet 10, and between radius of the ferromagnetic plate 21 and radius of the permanent magnet 10 is in the range of 9.10/9 to 11/9.

The foregoing description is only illustrative of the principle of the present invention. It is to be recognized and understood that the invention is not to be limited to the exact configuration as illustrated and described herein. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. In a magnetic fastener comprising a fastening element comprising:

a substantially circular first ferromagnetic component having a first diameter O, a substantially annular permanent magnet comprising an outer side wall having a diameter L, a central hole, and first and second end walls, first and second magnetic poles being formed on respective said first and second end walls, said permanent magnet positioned in abutment with said first ferromagnetic component, and a case made of non-magnetic material, said case comprising a case top and a substantially cylindrical outer side wall, said case top covering said permanent magnet with one of said magnetic poles contacting an interior of said case top; and an attracting element comprising a second circular ferromagnetic component having a second diameter S, the improvement wherein:

at least one of the two ratios O/L and S/L is between 9.1/9 and 11/9.

2. The improvement of claim 1, wherein both of the ratios are within the stated range.

3. The improvement of claim 1, wherein at least one of O/L and S/L are between 10.3/9 and 11/9.

4. The improvement of claim 3, wherein both ratios O/L and S/L are within the stated range.

5. The improvement of claim 3, wherein L is 18 mm and O and S are substantially identical.

6. A magnetic fastener comprising a fastening element and an attracting element, said fastener movable between an open position in which said elements are separated from one another and a closed position in which said elements abut one another, said fastening element comprising:

a substantially circular first ferromagnetic component having a first diameter O, and a substantially annular permanent magnet comprising an outer side wall having a diameter R, a central hole, and first and second end walls, first and second magnetic poles being formed on respective said first and second end walls, said permanent magnet positioned in abutment with said first ferromagnetic component, and said attracting element comprising:

a second substantially circular ferromagnetic component having a second diameter S, wherein at least one of the two ratios, O/L and S/L, is between 9.1/9 and 11/9.

7. The fastener of claim 6, wherein the first and second ferromagnetic components are ferromagnetic plates, each plate being formed with a hole formed in a center of that plate.

8. The fastener of claim 7, wherein a first rod is fixed in the hole of the first ferromagnetic plate, and a second rod is fixed in the hole of the second ferromagnetic plate, said first and second rods abutting one another within the central hole of the permanent magnet when the fastener is in the closed position.

9. The fastener of claim 8, wherein the first and second rods protrude from respective said first and second plates, said first and second rods abutting one another within the central hole of the permanent magnet when the fastener is in the closed position.

10. The fastener of claim 6, wherein both ratios are within the stated range.

* * * * *